US006049688A

United States Patent [19]

Hayashi et al.

[11] Patent Number: 6,049,688

[45] Date of Patent: Apr. 11, 2000

[54] TONER LAYER FORMING DEVICE FOR NON-MAGNETIC TONER

[75] Inventors: Kazumasa Hayashi, Hyogo; Akinori Toyoda; Hiroshi Komakine, both of Osaka, all of Japan

[73] Assignee: Matsushita Electric Industrial Co., Ltd., Osaka, Japan

[21] Appl. No.: 09/077,244

[22] PCT Filed: Sep. 26, 1997

[86] PCT No.: PCT/JP97/03454

§ 371 Date: May 21, 1998

§ 102(e) Date: May 21, 1998

[87] PCT Pub. No.: WO98/14836

PCT Pub. Date: Apr. 9, 1998

[30] Foreign Application Priority Data

| | | | |
|---|---|---|---|
| Sep. 30, 1996 | [JP] | Japan | 8-259807 |
| Dec. 16, 1996 | [JP] | Japan | 8-336165 |

[51] Int. Cl.[7] ..... G03G 15/08

[52] U.S. Cl. ..... 399/284; 399/285

[58] Field of Search ..... 399/279, 281, 399/284, 285, 286, 283

[56] References Cited

U.S. PATENT DOCUMENTS

| | | | |
|---|---|---|---|
| 5,404,211 | 4/1995 | Hashimoto et al. | 399/284 X |
| 5,477,006 | 12/1995 | Imamiya et al. | 399/285 |
| 5,570,164 | 10/1996 | Yamamoto et al. | 399/283 |
| 5,689,784 | 11/1997 | Shin et al. | 399/285 |
| 5,697,027 | 12/1997 | Takagi et al. | 399/279 |
| 5,729,806 | 3/1998 | Niwano et al. | 399/284 |
| 5,747,213 | 5/1998 | Okado et al. | 430/124 |

FOREIGN PATENT DOCUMENTS

| | | |
|---|---|---|
| 63-98678 | 4/1988 | Japan . |
| 1-54476 | 3/1989 | Japan . |
| 1-62675 | 3/1989 | Japan . |
| 2-116872 | 5/1990 | Japan . |
| 2-190877 | 7/1990 | Japan . |
| 3-81788 | 4/1991 | Japan . |
| 3-261976 | 11/1991 | Japan . |
| 4-269777 | 9/1992 | Japan . |
| 5-265311 | 10/1993 | Japan . |
| 7-199538 | 8/1995 | Japan . |

*Primary Examiner*—Fred L. Braun
*Attorney, Agent, or Firm*—Merchant & Gould P.C.

[57] ABSTRACT

A toner layer forming device is used for a developing device of an electrophotographic device, in which a toner holding member rotates in a predetermined direction while holding on its surface a nonmagnetic toner containing a detachant. A rotary toner layer control member whose surface rotates in the reverse direction to the surface of the toner holding member while contacting the surface with the surface of the toner holding member is provided in order to control the nonmagnetic toner layer. A toner removing member partially contacts with the surface of the rotary toner layer control member in order to scrape off the nonmagnetic toner held on the rotary toner layer control member, so that the toner on the rotary toner layer control member can be removed smoothly and a stable toner layer can be formed.

18 Claims, 2 Drawing Sheets

TONER LAYER FORMING DEVICE FOR NON-MAGNETIC TONER

TECHNICAL FIELD

This invention relates to a toner layer forming device used for developing devices to form images by an electrophotographic method, such as printers, copiers, and facsimile machines.

BACKGROUND ART

In conventional techniques, an elastic blade method has been used as a toner layer forming method in nonmagnetic one-component developing (developing by using a nonmagnetic toner only but not a magnetic carrier) devices in electrophotographic devices such as printers, copiers and facsimile machines in which images are formed by an electrophotographic method. An elastic blade method means forming a toner layer by urging the surface of the elastic blade to contact with a toner holding member. An advantage of this method is cost reduction due to the simple configuration, and stable toner thin layers can be formed with relative ease.

A problem in this method is, however, that toner will be adhered readily on the elastic blade that is a toner layer control surface since the elastic blade is fixed on the toner holding member, and thus, stability cannot be obtained over the course of time. In order to solve the problem, a rotary type toner layer forming method was suggested. In this method the toner control surface keeps changing relative to the toner holding member.

In this method, toner thin layers are formed by contacting the surface of a self-rotating roller-type toner layer control member (hereinafter, a rotary toner layer control member) with the surface of the toner holding member. Publication of Japanese Patent Application (Tokkai-Hei) No. 1-62675 discloses a toner layer forming method in which layers are formed stably by determining the peripheral speed of the rotary toner layer control member. Publication of Tokkai-Hei No. 3-81788 discloses another toner layer forming method for providing stable toner layers by applying d.c. bias and superimposing a.c. bias to a rotary toner layer control member in a rotary toner layer forming method.

In an ordinary rotary type toner layer forming method, a toner removing member (a scraper) for scraping off the toner on the rotary toner layer control member is urged into contact with the rotary toner layer control member. Publication of Tokkai-Hei 2-190877 discloses that the toner on a rotary toner layer control member is removed smoothly by determining the strength of the materials of the toner removing member and that of the rotary toner layer control member, resulting in a stable removing (scraping) property.

The nonmagnetic one-component development using such a conventional rotary toner layer forming method, however, will cause the following problems.

(1) In order to form stable toner layers for a long time in a rotary toner layer forming method, the rotary toner layer control member should be located so that its surface with no toner adhesion is always facing to the toner holding member.

For this purpose, the toner adhered to the rotary toner layer control member should be removed constantly by the toner removing member that is urged into contact with the rotary toner layer control member.

However, when the toner removing member deteriorates over time, a so-called scraping failure will occur, that is, the toner cannot be removed completely. Once a scraping failure occurs, a linear image failure is generated on a filial image (the toner image obtained on a recording material after transcription from a photoconductor).

When using a black toner containing carbon black, such a scraping failure merely occurs, because the carbon black adhering to the toner removing member functions as a lubricant, so the toner will be merely accumulated on the toner removing member. However, scraping failures occur frequently when using a color toner that does not contain carbon black and that uses a sharpmelt resin (a resin with low softening point and low melting viscosity) for a binder resin, resulting in serious problems.

(2) When a.c. bias is applied between the rotary toner layer control member and the toner holding member in order to form a toner layer stably, leakage of the ac. bias occurs and the toner layer formation becomes uneven. In a worst case, the toner is heated and melted by the excess current flowing in the toner and is adhered to the peripheral members (e.g., the toner holding member and the photoconductor), or the image unevenness is generated on the final image.

Such failures will often occur specifically when the toner holding member has low volume resistivity. Furthermore, the frequency of such problems caused by the a.c. bias leakage is extremely high compared to those of an elastic blade type device.

DISCLOSURE OF THE INVENTION

This invention aims to solve the above-mentioned problems, and a first object of this invention is to provide a toner layer forming device in which a toner adhered to a rotary toner layer control member is removed smoothly at any time, and a stable scraping property is obtained.

A second object of this invention is to provide a toner layer forming device in which bias leakage is extremely rare even if a.c. bias is applied to the rotary toner layer control member in order to form stable toner layers.

In order to achieve the above objects, a first toner layer forming device of this invention comprises: a roller-type toner holding member that rotates in a predetermined direction while holding a nonmagnetic toner containing detachant thereon; a roller-type toner layer control member that controls the nonmagnetic toner layer by rotating its surface in a reverse direction with respect to the surface of the toner holding member while contacting its surface with the surface of the toner holding member; and a toner removing member for scraping off the nonmagnetic toner held on the rotary toner layer control member by partially contacting with the surface of the rotary toner layer control member.

In the first toner layer forming device, a stable toner layer can be formed without occurrence of scraping failures of the toner adhered to the surface of the rotary toner layer control member for a long time.

The reason is considered as follows. Due to the toner's cyclic movement in the substantially V-shaped groove region formed between the rotary toner layer control member and the toner holding member, the toner impacts to the surfaces of the rotary toner layer control member and of the toner removing member. As a result, the detachant in the toner is adhered to the surfaces of the rotary toner layer control member and that of the toner removing member, and the surfaces will be modified to be sufficiently detachable from the toner.

It is preferable in the first toner layer forming device that the melting point of the detachant ranges from 80 to 90° C.

In the above toner layer forming device, the storage stability of the toner is improved (the toner will merely aggregate when stored at a high temperature) and the toner detachability from the surfaces of the rotary toner layer control member and the toner removing member is further improved during a toner layer forming operation. So a stable toner layer that is free from scraping failures can be formed over a long time.

The improvement in the detachability is considered due to the following reasons. A binder resin forming the toner base particles has a melting point of about 110° C., when the properties including optical transparency of the fixed images of the color toner are taken into consideration. When a wax having a melting point of 80–90° C. is used for the binder resin, the wax compound is melted effectively earlier than the binder resin in the toner because of the local temperature rise at some parts including the V-shaped toner cycling part and the part at which the toner removing member and the rotary toner layer control member contact with each other. As a result, the wax will be adhered evenly to the surfaces of the rotary toner layer control member and of the toner removing member.

In the first toner layer forming device, the detachant is preferably a wax.

In a toner layer forming device where the detachant is a wax, it is preferable that the wax is a polyolefin-based wax and the content of the polyolefin wax in the nonmagnetic toner is in the range of 2–20 weight %. When the weight of the wax is within the above range, a good scraping property can be provided and the toner degradation can be retarded.

In the first toner layer forming device, the detachant is preferably a carnauba wax. When the detachant is a carnauba wax with a melting point of about 83° C., the detachant will spread readily on which it adheres, and thus, the surfaces of the rotary toner layer control member and of the toner removing member can be modified in their detachability to the toner during the initializing (a short-periodic toner layer forming operation before the actual printing). As a result, a stable toner layer without a scraping failure can be formed from the initial stage of the printing operation.

In the toner layer forming devices whose detachant is a carnauba wax, it is preferable that the content of the carnauba wax in the nonmagnetic toner is at least 0.1 weight %, so that a good scraping property can be provided.

In the first toner layer forming device, it is preferable that the toner removing member comprises a metallic or resin plate member 20–50 $\mu$m thick, and the edge of the plate contacts with the surface of the rotary toner layer control member, so that the toner removing member will be operated more efficiently when it is assembled into a device, and a good scraping property can be maintained for a long time since excess toner will not be accumulated at the portion that the toner removing member and the rotary toner layer control member contact with each other during a toner layer formation (an ordinary printing operation).

The toner removing member is preferably a plate member of stainless steel, phosphor bronze, or polyethylene terephthalate (PEI).

In the first toner layer forming device, it is preferable that the surface of the rotary toner layer control member and the part of the toner removing member to contact with the surface of the rotary toner layer control member are made of the identical metallic material. In such a toner layer forming device, a stable scraping property can be maintained for a long time since neither member will be worn, or broken, and the edges of the toner removing member will not be broken due to the difference in hardness.

It is preferable that the metallic material is stainless steel.

A second toner layer forming device of this invention comprises a roller-type toner holding member that holds on its surface a nonmagnetic toner containing a detachant and rotates in a predetermined direction; a roller-type rotary toner layer control member whose surface rotates in the reverse direction to the rotating direction of the surface of the toner holding member while contacting its surface with the surface of the toner holding member; and a voltage generator that applies a.c. bias between the rotary toner layer control member and the toner holding member.

In the above-mentioned toner layer forming device, bias leakage to the metal core of the rotary toner layer control member and the metal core of the toner holding member can be prevented, and thus, images having high quality can be formed, since the toner is evenly dispersed without aggregating, and thus, the interface resistance (the interface resistance among the adjacent toner particles) of the toner that is prepared by adding a detachant to the toner base particles is high even if the toner is disturbed or vibrated by applying a.c. bias between the rotary toner layer control member and the toner holding member.

In the second toner layer forming device of this invention, it is preferable that the detachant is a wax and the content of the wax in the nonmagnetic toner is at least 3 weight %.

In the toner layer forming device in which a wax of at least 3 weight % is contained, it is preferable that the a.c. bias is more than 100 V and no more than 2000 V.

In the second toner layer forming device, it is preferable that the surface resistance value of the toner holding member is greater than the volume resistance value. According to the above-identified toner layer forming device, when the ac. bias is applied between the rotary toner layer control member and the toner holding member even if the a.c. bias is discharged due to some reasons such as contamination of metallic powder or condensation formation in the device, influences on the imaging electric field, which is given by the discharged current via the surface of the toner holding member, can be prevented.

It is also preferable that the toner holding member has an elastic layer comprising a hard surface layer and an inner layer that has less hardness compared to the surface layer. In such a toner layer forming device, the hard surface layer virtually prevents the toner holding member (the elastic layer) from being worn, so that the toner holding member has a longer life. In addition, as the inner layer is less hard, the urging force of the toner holding member to the photoconductor can be decreased so that the photoconductor can be driven at a lower torque. As a result, development with less image deterioration can be provided for a long time.

It is also preferable that an adhesive layer is formed between the surface layer and the inner layer in order to adhere the two layers. In the toner layer forming device, the surface resistance value of the toner holding member is controlled by controlling the resistance value of the surface layer, and the volume resistance value of the toner holding member can be controlled by controlling the resistance values of the inner layer and of the adhesive layer.

As a result, materials for the inner layer can be selected according to any required properties except for the electrical properties (the surface resistance value and the volume resistance value) of the toner holding member without taking the electrical property into consideration, so a further variety of toner holding members can be designed.

BEST MODE FOR CARRYING OUT THE INVENTION

Figure 1:
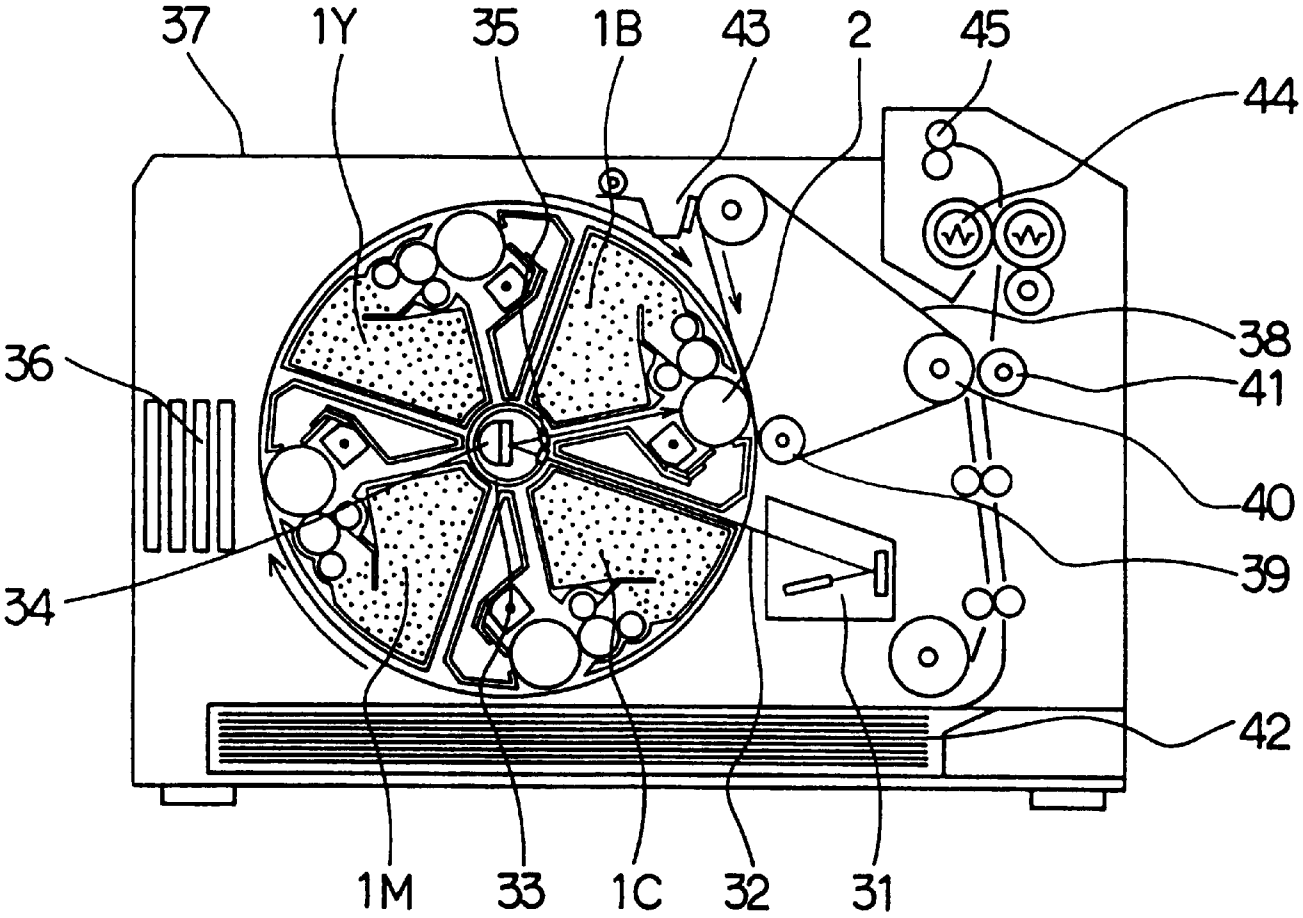
FIG. 1 is a cross-sectional view of one embodiment of a color electrophotographic device loaded with a toner layer forming device of this invention.

The embodiments of this invention will be explained below. First, an embodiment of a color electrophotographic device loaded with a toner layer forming device is described by referring to FIG. 1. FIG. 1 shows the entire configuration of one embodiment of a color electrophotographic device. At the center of the device, four sets of sectorial image forming units 1Y, 1M, 1C, 1B, which are prepared respectively for the yellow toner, magenta toner, cyan toner, and black toner, are located annularly.

The image forming units 1Y, 1M, 1C, 1B are supported by supporters (not shown), driven as a whole by a transfer motor (not shown) that is a transfer means controlled with a control circuit 36, and the units rotate around the cylindrical fixed shaft 33 in the direction indicated by the arrow. The respective image forming units 1Y, 1M, 1C, 1B are transferred to the image forming position opposing the transcription roller 39 supporting the intermediate transcription belt 38 that will be mentioned below. The supporters for the image forming units 1Y, 1M, 1C, 1B are provided with a detection means (not shown) for detecting the transfer of each image forming unit to each image forming position. Before each unit completes its transfer, signals corresponding to the transfer completion are sent to the control circuit 36.

A laser exposure device 31 generates signal light 32 of a laser beam modulated with the signals that are inputted into a printer part. The signal light 32 passes an optical path formed between the image forming units 1B and 1C, enters the optically-corrective means 34 that is a cylindrical lens inside the shaft 33 via a transparent window 35 provided to a part of the shaft 33, where the signal light is reflected and radiates the photoconductor 2 of the image forming unit located at the image forming position in order to form a latent image.

In FIG. 1, a latent image is formed at the photoconductor 2 of the image forming unit 1B for black. As the optical path to the optically-corrective means 34 is formed along the wall of the sectorial image forming unit, substantially all regions occupied by the image forming units are effectively used. As the optically-corrective means 34 is provided at the center of the image forming units, it is made simple and reliable regarding positioning or some other objectives.

The optically-corrective means 34 of this method is provided at the center of the image forming units, while in a conventional method, all optical corrections are conducted in the exposure device 31 and a planar mirror is provided inside the shaft 33 to change the direction of the laser beam. In the former method, the optical correction is conducted at a position nearer to the image-formation position and thus, accuracy can be improved regarding the deviation of the laser beam to the image forming position, or regarding the beam shape.

Though a cylindrical lens is used for the optically-corrective means 34 in this embodiment, a similar effect is obtainable by using a cylinder mirror or some other means. The optical path is designed so that the reflecting face of the optically-corrective means faces downward. Therefore, dust will not tend to be accumulated inside the device.

The intermediate transcription belt 38 comprises, for example, a film made of semiconductive urethane as an endless belt 100 $\mu$m thick. It is wound around the transcription roller 39 having urethane foam on its circumference and a stainless steel roller 40, and moves to the direction as indicated by an arrow.

The transcription roller 39 is slightly urged into contact with the photoconductor 2 of the image formation unit 1B via the intermediate transcription belt 38. A second transcription roller 41 having the same configuration as the transcription roller 39 is slightly urged into contact with the roller 40 via the intermediate transcription belt 38 in order to enable a driven-rotation.

A paper traveling path is formed at the nipped part where the intermediate transcription belt 38 and the second transcription roller 41 are urged into contact with each other, so that paper will be conveyed from the feeder 42.

A belt cleaning unit 43 to clean the intermediate transcription belt 38 comprises a belt cleaner. A fixer 44 fixes the toner image on the paper after transcription, and a discharging roller 45 discharges the paper on which the image is fixed.

After the image forming operation by the image forming unit 1B, the image forming units (1B, 1Y, 1M, 1C) are driven as a whole by the transfer motor and rotate together in the direction as indicated by the arrow in FIG. 1. The rotation stops when the image forming unit 1Y reaches the image forming position after rotating by 90 degree, and the image forming unit 1Y is positioned.

As the image forming unit 1Y excepting the photoconductor 2 is positioned inside the rotating arc of the photoconductor tip, the intermediate transcription belt 38 will not contact with the image forming unit. In the same manner as the image forming unit 1B, the laser exposure device inputs signal light in the image forming unit 1Y, corresponding to the yellow signals, so that a yellow toner image is formed and transcribed.

At this time, timing to write for the yellow signal light is controlled in order to adjust the position of the previously-transcribed black toner image and that of the following yellow toner image on the intermediate transcription belt 38. The second transcription roller 41 and the cleaner 43 are separated a little from the intermediate transcription belt in this operation, and therefore, they have no influence on the toner on the intermediate transcription belt.

Similar operations are repeated for the magenta and cyan toners, and a color image is formed on the intermediate transcription belt as the four-colored toner image is coincided and overlapped. After the last cyan toner is transcribed, the four-colored toner image is batch-transcribed by the action of the second transcription roller 41 on the paper delivered from the feeder 42 by adjusting the timing. The toner image transcribed on the paper is fixed by the fixer 44. The paper is discharged outside the device through the discharging roller 45.

Figure 2:
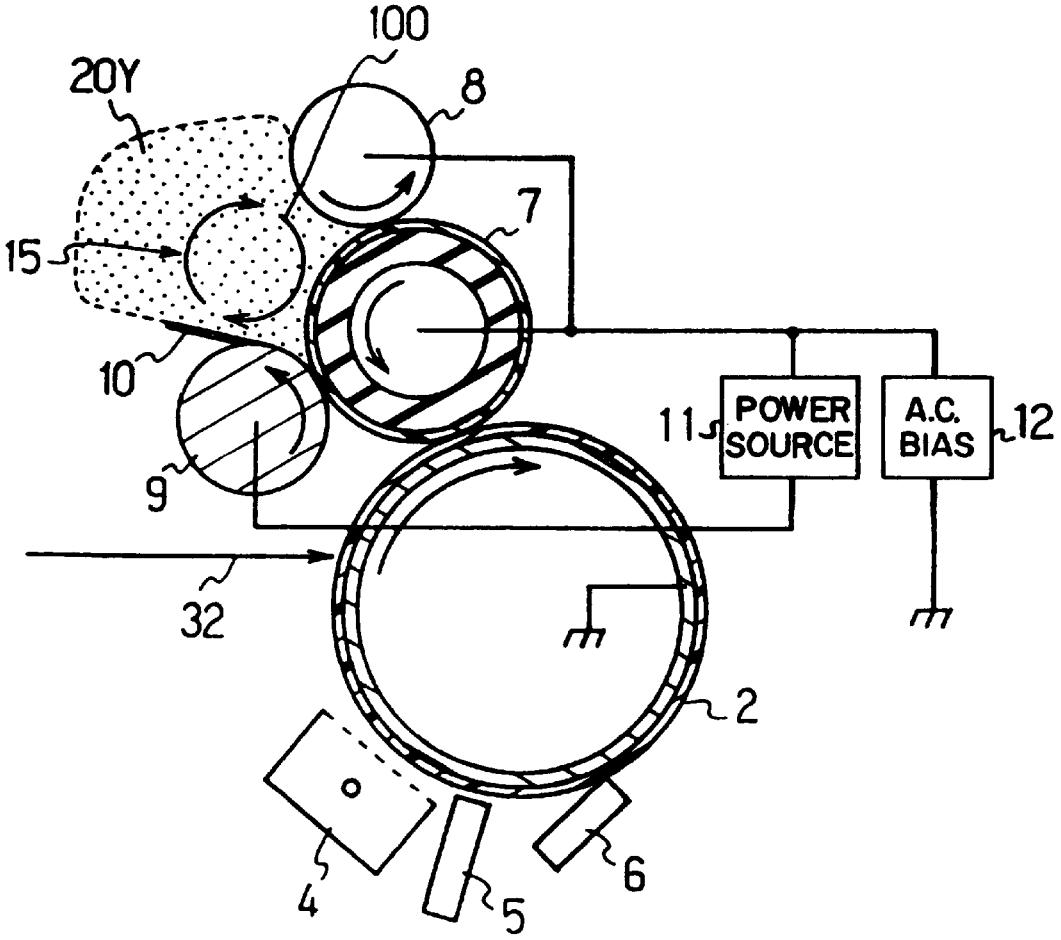
FIG. 2 is a side view of one embodiment of a toner layer forming device of this invention.

FIG. 2 is a side view showing a toner layer forming device contained in the image forming unit 1Y according to the embodiment. The image forming units 1B, 1Y, 1M and 1C have substantially the same configuration except for the inside toners, so the toner layer forming device in this embodiment can be used in the other image forming units 1Y, 1M and 1C.

20Y is a nonmagnetic one-component toner for yellow color. The laminated organic photoconductor 2 mainly comprises phthalocyanine, the outer diameter is 30 mm, and it rotates in the direction as indicated by the arrow. The charger 4 negatively charges the photoconductor, and the exposure signal 32 is a signal from a laser.

The toner holding member 7 rotates in the direction as indicated by the arrow. It is preferable that the surface resistance value for the toner holding member 7 is predetermined to be greater than the volume resistance value, since current would flow from the toner layer control member 9 to the photoconductor along the surface of the toner layer holding member 7 if the surface resistance value of the toner holding member 7 is the same or lower than the volume resistance value, resulting in a disturbed image quality.

When the surface resistance value of the toner holding member 7 is determined to be higher than the volume resistance value, if a.c. bias applied between the toner holding member 7 and the toner layer control member 9 discharges, influence of the discharged current on the latent image through the toner holding member can be prevented.

The lower limits of the surface resistance value and the volume value are determined according to the a.c. bias power source capacity applied between the rotary toner layer control member and the toner holding member while the upper limits are determined according to the charge residence phenomenon at the toner.

More specifically, it is preferable that the surface resistance value of the toner holding member 7 is determined to be about 2 times to 100 times the volume resistance value. A satisfactory result was obtained when the surface resistance value was determined to be in the range from $6.0\times10^4$ to $5.0\times10^9\Omega$ while the volume resistance value ranges from $2.0\times10^3$ to $4.0\times10^7\Omega$.

When the toner holding member 7 is an elastic roller, the resistance value of this member also can be raised. When the elastic layer of the toner holding member is a hard surface layer, the surface resistance value can be raised; when the inner layer is less hard than the surface layer, the volume resistance value can be lowered.

The toner holding member preferably has a laminated structure in order to control the volume resistance value and the surface resistance value separately in the toner holding member, and the most preferable is a three-layered structure having an adhesive layer between the surface layer and the inner layer, since the volume resistance value and the surface resistance value can be controlled respectively in a comparatively simple manner by controlling the resistance value of the adhesive layer.

Based on the above results, the toner holding member 7 can be a rotary roller-type member comprising, for example, a silicone rubber (JIS-A hardness is 16 degree, the volume resistance value is $2\times10^3\Omega\cdot$cm) of 3 mm thick with low hardness on which urethane of 20 $\mu$m thickness is coated through an adhesive layer of $1\times10^4\Omega$. The surface roughness (Ra) is 0.18 $\mu$m, and fine silica of 2 weight % is blended with the surface layer urethane in order to roughen the urethane and to improve the toner delivering ability. One example of the resistance value is that the surface resistance value is $2.0\times10^6\Omega$ and the volume resistance value is $5.3\times10^5\Omega$.

It is also preferable that the inner silicone layer has as low a hardness as possible, more specifically, the JIS-A hardness is no more than 30 degree, since when the inner silicone layer is less hard, less pressure is required to obtain a nipping for the photoconductor 2, and the photoconductor 2 can be driven at a low torque.

The developing bias power source 11 applies developing bias to the toner holding member 7. The toner feeding roller 8 feeds toners to the toner holding member 7, and it is a roller of urethane foam which rotates in the direction as indicated by the arrow. The rotary toner layer control member 9 is a rotary toner layer control member comprising a stainless steel material (e.g. SUS303, SUS304), which rotates and controls the thickness of the toner layer on the toner holding member 7.

The tip edge of the toner removing member 10 contacts with the rotary toner layer control member 9. The toner on the rotary toner layer control member is scraped off by the toner removing member 10. The toner removing member 10 is a plate member of 30 $\mu$m thick comprising, for example, a stainless steel material (e.g. SUS303, SUS304).

It is preferable that the rotary toner layer control member 9 and the toner removing member 10 are prepared from the same materials. If not, a stable scraping property is difficult to obtain since one of them will be worn or broken due to the difference in their material hardness after a long term use.

In particular, it is extremely difficult to obtain a stable scraping property if the edge of the toner removing member is broken. Some materials, however, can provide a good scraping property as shown in the following Examples, even if they are not identical.

The a.c. bias 12 applies rectangular a.c. bias between the rotary toner layer control member 9 and the toner holding member 7. The a.c. bias has, for example, amplitude of 300 V and frequency of 2 kHz.

The rotary toner layer control member 9 and the toner holding member 7 are urged into contact with each other and have a nipping of, for example, 200 μm. The toner holding member 7 and the photoconductor 2 are also urged into contact with each other and the nipping is, for example, 150 μm.

A charge eliminating lamp 5 comprises a red LED array, which is designed to radiate a predetermined quantity of light toward an organic photoconductor 2 for a predetermined time.

The organic photoconductor 2, the toner holding member 7 and the rotary toner layer control member 9 rotate in the direction as indicated by the arrow. For example, the diameter of the organic photoconductor 2 is 30 mm, and the peripheral speed is 105 mm/s. As for the toner holding member 7, the diameter is 20 mm and the peripheral speed is 180 mm/s. As for the rotary toner layer control member 9, the diameter is 10 mm and the peripheral speed is 35 mm/s.

It is also possible that the peripheral speed of the organic photoconductor 2 is determined in the range of 70–150 mm/s, that of the toner holding member 7 is determined in the range of 120–270 mm/s, and that of the rotary toner layer control member 9 is determined in the range of 10–80 mm/s respectively.

A cleaner blade 6 is used to clean the residual toner on the photoconductor after transcription, and the blade comprises an urethane material.

The following is the explanation about one embodiment of image formation by using the above toner layer forming device. The photoconductor 2 was charged to be −700 V with a charger 4. This photoconductor 2 was irradiated with an exposure signal 32 by a laser in order to form an electrostatic latent image. At this time, the complete exposure electric potential was −100 V.

The surface of this photoconductor 2 was opposed to the toner holding member 7 that supported the nonmagnetic one-component toner 20Y and that rotated in the same direction as the photoconductor 2, and a direct voltage of −500 V was applied from the developing bias power source 11 to the toner holding member 7.

As a result, only a negative-positive inverted toner image was left on the image part of the photoconductor 2. The toner image on the photoconductor 2 was transcribed on the transcription position (not shown) of the transcription belt (not shown). On the other hand, the toner left on the photoconductor 2 after the transcription was removed by using the cleaner blade 6, and the photoconductor 2 was treated with the charge eliminating lamp 5.

The present invention will be explained more specifically referring to Examples. In the Examples, the above-mentioned toner layer forming device is used while the following elements are changed respectively: the kinds and weight of the detachants; the materials for the rotary toner layer control member and of the toner removing member; the thickness of the toner removing member; and the magnitude of the a.c. bias.

EXAMPLES 1–17. COMPARATIVE EXAMPLE 1

Table 1 shows the experimental results in Examples 1–17 and Comparative Example 1. In the Examples, wax is used as the detachant contained in the toner. The content of the wax is varied in Examples 1–8 while, the content of carnauba wax used as the detachant in the toner is varied in Examples 9–17.

Polyethylene wax having a melting point of 105° C. is used for the wax. The wax in Tables 1–4 is polyethylene wax. Removing members in Tables 1–4 are toner removing members, and control members are rotary toner layer control members. The a.c. bias frequency in Tables 1–3 is 1 kHz.

In Example 1, a toner was prepared in the following manner:

mixing and dispersing a polyester resin of 91 weight %, a benzene-based yellow pigment as a colorant of 5 weight %, a charge control agent of 3 weight % and wax of 1 weight %;

pulverizing and classifying this mixture to obtain nonmagnetic toner base particles whose average diameter was 6.5 μm and to which is added (mixing) 1 weight % of hydrophobic silica as a surface modifier when the toner base particle was 99 weight %.

In Examples 2–8, the content of wax was varied in the range of 2–25 weight %. For comparison, the experiment was conducted without using wax (Comparative Example 1).

In Examples 9–17, a carnauba wax was used and the content of the carnauba wax was varied in the range of 0.1–25 weight %. The melting point of the carnauba wax is about 83° C.

In the respective Examples (and also in Examples 18–77), the weight of the polyester resin was varied to compensate the varying contents of the wax and carnauba wax.

The Examples and the Comparative Example were evaluated with respect to the number of continuous prints that can be done without generating any scraping failures (hereinafter, scrape number).

Table 1 shows the results of the experiments.

TABLE 1

| | Detachant | Detachant content (wt %) | Materials of removing · control members | Thickness of removing member (μm) | a.c. bias (V) | Scrape number (sheets) |
|---|---|---|---|---|---|---|
| Com. Ex. 1 | None | 0 | Stainless steel | 30 | 400 | 2800 |
| Ex. 1 | Wax | 1 | ↑ | ↑ | ↑ | 6500 |
| Ex. 2 | ↑ | 2 | ↑ | ↑ | ↑ | 11000 |

TABLE 1-continued

| | Detachant | Detachant content (wt %) | Materials of removing · control members | Thickness of removing member (μm) | a.c. bias (V) | Scrape number (sheets) |
|---|---|---|---|---|---|---|
| Ex. 3 | ↑ | 3 | ↑ | ↑ | ↑ | 17000 |
| Ex. 4 | ↑ | 7 | ↑ | ↑ | ↑ | 18000 |
| Ex. 5 | ↑ | 10 | ↑ | ↑ | ↑ | 25000 |
| Ex. 6 | ↑ | 15 | ↑ | ↑ | ↑ | 25000 |
| Ex. 7 | ↑ | 20 | ↑ | ↑ | ↑ | 35000 |
| Ex. 8 | ↑ | 25 | ↑ | ↑ | ↑ | 36000 |
| Ex. 9 | Carnauba wax | 0.1 | ↑ | ↑ | ↑ | 13000 |
| Ex. 10 | ↑ | 0.2 | ↑ | ↑ | ↑ | 16000 |
| Ex. 11 | ↑ | 0.5 | ↑ | ↑ | ↑ | 18000 |
| Ex. 12 | ↑ | 1 | ↑ | ↑ | ↑ | 42000 |
| Ex. 13 | ↑ | 5 | ↑ | ↑ | ↑ | 58000 |
| Ex. 14 | ↑ | 10 | ↑ | ↑ | ↑ | 73000 |
| Ex. 15 | ↑ | 15 | ↑ | ↑ | ↑ | 78000 |
| Ex. 16 | ↑ | 20 | ↑ | ↑ | ↑ | 80000 |
| Ex. 17 | ↑ | 25 | ↑ | ↑ | ↑ | 85000 |

As clearly shown in Table 1, the scrape number in Example 1 where the content of wax is 1 weight % is remarkably increased from 2800 to 6500 compared to that of Comparative Example 1 in which the wax is 0 weight %. In Examples 2–8, in which wax of at least 2 weight % is contained, the scrape number is further increased, showing good results. It is shown that the scrape number increases according to the increase of wax content.

In Example 8 in which 25 weight % of wax is contained, however, the toner will deteriorate readily though the scrape number was 36000 and showed a good result.

Based on this result, the preferable wax content is within 2–20 weight %, more preferably, 3–20 weight %, considering the scrape number and the toner deterioration.

In Examples 9–17 where carnauba wax of 0.1–25 weight % was contained, the scrape number was 13000 or more and showed a good result.

The scrape number increased according to the increase of the carnauba wax content. In Example 17 where the wax content was 25 weight %, the scrape number was 85000, and it was extremely good.

As a result, preferable content of the carnauba wax is at least 0.1 weight %, more preferably at least 1 weight %, considering the scrape number.

In this experimental result, the scraping property is improved when wax is contained in the toner. As shown in FIG. 2, a toner moves cyclically (shown by the arrow 100) at a substantially V-shaped groove region 15 formed between the rotary toner layer control member 9 and the toner holding member 7. Due to this movement, the toner impacts on the surfaces of the rotary toner layer control member 9 and of the toner removing member 10. Then, the wax in the toner adhered to the surfaces of the rotary toner layer control member 9 and the toner removing member 10, so that these surfaces are modified to have sufficient detachability with respect to the toner.

EXAMPLES 18–52

In the Examples shown in Table 1, the thickness of the toner removing member 10 is determined to be 30 μm, while in the Examples in Table 2, the thickness of the toner removing member 10 is varied in the range of 10–60 μm. Experiments were conducted by varying the kinds and contents of the detachants as in Examples 1–17 when the thickness of the toner removing member 10 was fixed at each value.

The results are shown in the following Table 2.

TABLE 2

| | Detachant | Detachant content (wt %) | Materials of removing · control members | Thickness of removing member (μm) | a.c. bias (V) | Scrape number (sheets) |
|---|---|---|---|---|---|---|
| Ex. 18 | Wax | 1 | Stainless Steel | 10 | 400 | 2200 |
| Ex. 19 | ↑ | 3 | ↑ | ↑ | ↑ | 11000 |
| Ex. 20 | ↑ | 15 | ↑ | ↑ | ↑ | 17000 |
| Ex. 21 | Carnauba wax | 0.1 | ↑ | ↑ | ↑ | 6000 |
| Ex. 22 | ↑ | 0.2 | ↑ | ↑ | ↑ | 12000 |
| Ex. 23 | ↑ | 10 | ↑ | ↑ | ↑ | 22000 |
| Ex. 24 | ↑ | 20 | ↑ | ↑ | ↑ | 48000 |
| Ex. 25 | Wax | 1 | ↑ | 20 | ↑ | 4200 |
| Ex. 26 | ↑ | 3 | ↑ | ↑ | ↑ | 12500 |
| Ex. 27 | ↑ | 15 | ↑ | ↑ | ↑ | 19000 |
| Ex. 28 | Carnauba wax | 0.1 | ↑ | ↑ | ↑ | 9500 |
| Ex. 29 | ↑ | 0.2 | ↑ | ↑ | ↑ | 14000 |
| Ex. 30 | ↑ | 10 | ↑ | ↑ | ↑ | 30500 |
| Ex. 31 | ↑ | 20 | ↑ | ↑ | ↑ | 55000 |
| Ex. 32 | Wax | 1 | ↑ | 40 | ↑ | 5500 |

TABLE 2-continued

| | Detachant | Detachant content (wt %) | Materials of removing · control members | Thickness of removing member (μm) | a.c. bias (V) | Scrape number (sheets) |
|---|---|---|---|---|---|---|
| Ex. 33 | ↑ | 3 | ↑ | ↑ | ↑ | 15000 |
| Ex. 34 | ↑ | 15 | ↑ | ↑ | ↑ | 23000 |
| Ex. 35 | Carnauba wax | 0.1 | ↑ | ↑ | ↑ | 11500 |
| Ex. 36 | ↑ | 0.2 | ↑ | ↑ | ↑ | 15000 |
| Ex. 37 | ↑ | 10 | ↑ | ↑ | ↑ | 55000 |
| Ex. 38 | ↑ | 20 | ↑ | ↑ | ↑ | 62500 |
| Ex. 39 | Wax | 1 | ↑ | 50 | ↑ | 3800 |
| Ex. 40 | ↑ | 3 | ↑ | ↑ | ↑ | 13000 |
| Ex. 41 | ↑ | 15 | ↑ | ↑ | ↑ | 18000 |
| Ex. 42 | Carnauba wax | 0.1 | ↑ | ↑ | ↑ | 8500 |
| Ex. 43 | ↑ | 0.2 | ↑ | ↑ | ↑ | 14500 |
| Ex. 44 | ↑ | 10 | ↑ | ↑ | ↑ | 28000 |
| Ex. 45 | ↑ | 20 | ↑ | ↑ | ↑ | 50000 |
| Ex. 46 | Wax | 1 | ↑ | 60 | ↑ | 2400 |
| Ex. 47 | ↑ | 3 | ↑ | ↑ | ↑ | 12000 |
| Ex. 48 | ↑ | 15 | ↑ | ↑ | ↑ | 16000 |
| Ex. 49 | Carnauba wax | 0.1 | ↑ | ↑ | ↑ | 7000 |
| Ex. 50 | ↑ | 0.2 | ↑ | ↑ | ↑ | 12000 |
| Ex. 51 | ↑ | 10 | ↑ | ↑ | ↑ | 23000 |
| Ex. 52 | ↑ | 20 | ↑ | ↑ | ↑ | 28000 |

Table 2 shows that when the thickness of the toner removing member is increased from 10 μm (Example 19) to 20 μm (Example 26), the scrape number increases from 11000 to 12500 if the detachant is a wax of 3 weight %.

When the thickness of the toner removing member is increased to 30 μm (Example 3 in Table 1), the scrape number further increases to be 17000. When the thickness is increased to be 40 μm (Example 33), the scrape number begins to decrease while it keeps a high level of 15000.

The scrape number decreases as the thickness further increases to be 50 μm (Example 40) and to 60 μm (Example 47). In Example 47 where the thickness is 60 μm, the scrape number is 12000, in other words, the number decreases to the level of Example 19 where the thickness is 10 μm.

A similar trend can be found if the detachant is carnauba wax, or if the content of the wax/carnauba wax varies. The toner removing member is preferably 20–50 μm thick, more preferably, 30–40 μm.

When the thickness exceeds 50 μm, the toner accumulates excessively at the junction with the rotary toner layer control member. As a result, the toner removing property deteriorates. When the thickness is less than 20 μm, the toner removing member is difficult to operate, and the rigidity is too low thus lowering the scrape ability.

EXAMPLES 53–56

In the Examples shown in Tables 1 and 2, the materials for the rotary toner layer control members and the toner removing members are coordinated and stainless steel is also used. In Examples 53–56 shown in Table 3, these materials are varied.

The experimental results are shown in Table 3.

TABLE 3

| | Detachant | Detachant content (wt %) | Material of control member | Material of removing member | Thickness of removing member (μm) | a.c. bias (V) | Scrape number (sheets) |
|---|---|---|---|---|---|---|---|
| Ex. 53 | Carnauba wax | 0.2 | Stainless steel | Phosphor bronze | 30 | 400 | 11500 |
| Ex. 54 | ↑ | 10 | ↑ | ↑ | ↑ | ↑ | 26000 |
| Ex. 55 | ↑ | 0.2 | Aluminum | PET | ↑ | ↑ | 12000 |
| Ex. 56 | ↑ | 10 | ↑ | ↑ | ↑ | ↑ | 24500 |

As shown in Table 3, good scrape number was obtained in every case that the rotary toner layer control member was stainless steel and the toner removing member was phosphor bronze (Examples 53, 54); that the rotary toner layer control member was aluminum and the toner removing member was polyethylene terephthalate (PEI) (Examples 55, 56).

However, the scrape number in Examples 53–54 is less than that of Examples 10 and 14, when the condition is the same as Examples 10 and 14 except that the material for both the rotary toner layer control member and the toner removing member is stainless steel. Considering the result, it is more preferable that the toner layer control member and the toner removing member are made of the identical materials.

EXAMPLES 57–77, COMPARATIVE EXAMPLES 2–3

In the Examples shown in Tables 1–3, the level of the a.c. bias is fixed, while the a.c. bias is varied in Examples 57–77 shown in Table 4. In these Examples, the a.c. bias is varied in the range of 100–2500 V and evaluation is based on the leakage frequency (%). In Comparative Examples 2 and 3, detachants are not used.

Leakage frequency (%) is calculated by leakage number/continuous printing number. The frequency of the a.c. bias is fixed to be 2 kHz.

Table 4 shows the experimental result.

TABLE 4

| | Detachant | Detachant content (wt %) | Materials of removing · control members | Thickness of removing member (μm) | a.c. bias (V) | Leakage number/ Sheet | Leakage frequency (%) |
|---|---|---|---|---|---|---|---|
| Com. Ex. 2 | None | 0 | Stainless steel | 30 | 100 | 315/1500 | 21.00 |
| Ex. 57 | Wax | 1 | ↑ | ↑ | ↑ | 180/3000 | 6.00 |
| Ex. 58 | ↑ | 3 | ↑ | ↑ | ↑ | 97/20000 | 0.49 |
| Ex. 59 | ↑ | 15 | ↑ | ↑ | ↑ | 10/20000 | 0.05 |
| Com. Ex. 3 | None | 0 | ↑ | ↑ | 200 | 546/1500 | 36.40 |
| Ex. 60 | Wax | 1 | ↑ | ↑ | ↑ | 228/3000 | 7.60 |
| Ex. 61 | ↑ | 3 | ↑ | ↑ | ↑ | 103/20000 | 0.52 |
| Ex. 62 | ↑ | 15 | ↑ | ↑ | ↑ | 27/20000 | 0.14 |
| Ex. 63 | ↑ | 1 | ↑ | ↑ | 500 | 305/3000 | 10.12 |
| Ex. 64 | ↑ | 3 | ↑ | ↑ | ↑ | 128/20000 | 0.64 |
| Ex. 65 | ↑ | 15 | ↑ | ↑ | ↑ | 34/20000 | 0.17 |
| Ex. 66 | ↑ | 1 | ↑ | ↑ | 1000 | 441/3000 | 14.70 |
| Ex. 67 | ↑ | 3 | ↑ | ↑ | ↑ | 135/20000 | 0.68 |
| Ex. 68 | ↑ | 15 | ↑ | ↑ | ↑ | 41/20000 | 0.21 |
| Ex. 69 | ↑ | 1 | ↑ | ↑ | 1500 | 630/3000 | 21.00 |
| Ex. 70 | ↑ | 3 | ↑ | ↑ | ↑ | 252/20000 | 1.26 |
| Ex. 71 | ↑ | 15 | ↑ | ↑ | ↑ | 202/20000 | 1.01 |
| Ex. 72 | ↑ | 1 | ↑ | ↑ | 2000 | 721/3000 | 24.03 |
| Ex. 73 | ↑ | 3 | ↑ | ↑ | ↑ | 360/20000 | 1.80 |
| Ex. 74 | ↑ | 15 | ↑ | ↑ | ↑ | 240/20000 | 1.20 |
| Ex. 75 | ↑ | 1 | ↑ | ↑ | 2500 | 902/30000 | 30.07 |
| Ex. 76 | ↑ | 3 | ↑ | ↑ | ↑ | 553/20000 | 2.77 |
| Ex. 77 | ↑ | 15 | ↑ | ↑ | ↑ | 407/20000 | 2.04 |

Table 4 shows that the detachant contained in the toner lowers the leakage frequency remarkably. For instance, leakage frequency is 21.0% in Comparative Example 2 comprising no detachant, while leakage frequency is lowered to 6.00% in Example 57 where the condition is identical to Comparative Example 2 except that wax of 1 weight % is contained.

This relationship is also found between Comparative Example 3 and Example 60, in both of which the ac. bias is 200 V. Leakage frequency is 36.4% in Comparative Example 3 while it declined to 7.60% in Example 60.

It is also clear that leakage frequency is decreased as the wax content is increased. Examples 60–62 are common in the condition except for the wax content. When the content increases from 1% to 3% to 15%, leakage frequency decreases from 7.60 to 0.52 to 0.14%. This relationship also can be seen in other Examples where the a.c. bias is varied.

In some Examples where the a.c. bias is no more than 2000 V and at least 3 weight % of wax is contained, leakage frequency ranges from 0.14% (Example 62) to 1.80% (Example 73), which will not cause any problems for a practical use. When a.c. bias ranges 200–1000V and wax content is at least 3 weight %, leakage frequency ranges from 0.14% (Example 62) to 0.68% (Example 67), so it is particularly good.

In Examples 58 and 59, at least 3 weight % of wax is contained and the a.c. bias is 100 V. Although the leakage frequency was low (0.49% and 0.05% respectively) the toner layer was not formed with sufficient evenness.

The result in Table 4 indicates that the preferable a.c. bias is greater than 100 V and no more than 2000 V, more preferably, it should be more than 100 V and no more than 1000 V.

It is also preferable that the frequency of the a.c. bias ranges from 200 Hz to 3 kHz. When it is less than 200 Hz, a toner layer cannot be formed evenly. When it exceeds 3 kHz, the toner cannot follow the a.c. bias, and the substantial effect will be reduced.

This invention is not limited to the above-mentioned representative Examples, but the following examples can be also applied.

The effect can be further improved by using a nonmagnetic toner to which polyvinylidene fluoride resin powder is added.

The scraping property is stabilized by coating the surface of the rotary toner layer control member with fluorine resin. The reason may be that the toner detachability of the rotary toner layer control member surface is improved, and thus, the scraping property is improved.

For the fluorine resin, the following compounds, for instance, can be used: PTFE (polytetrafluoroethylene), a copolymer of tetrafluoroethylene and perfluoro alkyl vinyl ether (PFA), a copolymer of tetrafluoroethylene and hexafluoroethylene (FEP), a copolymer of tetrafluoroethylene and ethylene (FTFE), an ethylene difluoride compound (PVDF), and a mixture of at least two of the above-mentioned compounds.

Though laminated toner holding members in which the surface layer is urethane and the lower layer is less hard silicone are used in the above Examples, substantially similar effects can be obtained if a single layer type toner holding member either of urethane or silicone is used.

Though fine silica is blended in the Examples to roughen the surface of the toner holding member, other spherical fine resin particles such as polyethylene, polypropylene and polymethylmethacrylate also can be blended.

The surface roughness (Ra) of the toner holding member ranges preferably from 0.1–3 μm. When the surface roughness (Ra) is less than 0.1 μm, the evenness of the toner delivery tends to deteriorate, and when it exceeds 3 μm, the quality of the final image will be lowered (the graininess becomes remarkable and the resolution is lowered).

Carbons or metal oxides such as $Al_2O_3$, $SnO_2$, and $TiO_2$ also can be blended in the urethane layer or the silicone layer in order to control the resistance value.

Polyethylene wax and carnauba wax, which are used as detachants to be added in the toner base particles, can be replaced by other kinds of waxes.

The following synthetic or natural waxes can be also used for this purpose: paraffin wax, low molecular weight polyethylene, ethylene-vinyl acetate copolymer wax, low molecular weight polyolefin such as low molecular polypropylene, ethyleneacrylic acid copolymer wax, copolymer wax of α-olefin and ethylene, polyolefin-based waxes such as ethylenebisamide, paraffin wax, grafted paraffin wax, montan wax, and so on.

Ethylene-vinyl acetate copolymer can be mixed with silicone oil, or the above waxes can be used with surface active agents.

The toner binder resins used in this invention are, for instance, polyester-based resin or styreneacryl-based copolymer resin that have been used in this field as the binder resins for color toners. The polyester resin is synthesized, for example, from a polyol component and dicarboxylic acid.

The polyol component is selected, for example, from the following: ethylene glycol; triethylene glycol; 1,2-propylene glycol; 1,3-propylene glycol; 1,4-butanediol; 1,4-bis (hydroxymethyl) cyclohexane; bisphenol A; hydrogenated bisphenol A, and polyoxyethylene bisphenol A.

Dicarboxylic acids include: maleic acid; fumaric acid; mesaconic acid; citraconic acid; itaconic acid; glutaconic acid; phthalic acid; isophthalic acid; terephthalic acid; succinic acid; adipic acid; sebacic acid; malonic acid; 1,2,4-benzene tricarboxylic acid; 1,2,5-benzene tricarboxylic acid; 1,2,4cyclohexane tricarboxylic acid; 1,2,5-cyclohexane tricarboxylic acid; 1,2,4-butane tricarboxylic acid; 1,3-dicarboxy-2-methyl-2-methylcarboxypropanetetra (methylcarboxy)methane.

Styrene-based monomers of the styreneacrylic copolymer resin are selected from, for instance, styrene, α-methylstyrene, p-chlorostyrene and the derivatives thereof, and styrene is most preferable among them.

Acrylic acid monomer is selected from monocarboxylic acid having double bonds and the substitutes, such as acrylic acid; methyl acrylate; ethyl acrylate; butyl acrylate; dodecyl acrylate; octyl acrylate; isobutyl acrylate; hexyl acrylate; methyl methacrylate; ethyl methacrylate; butyl methacrylate; octyl methacrylate; isobutyl methacrylate; dodecyl methacrylate; and hexyl methacrylate. Among them, a linear polyester having a softening point ranging from 90–120° C. (measured with a FLOW-TESTER JIS K 7210) is specifically preferred.

For the toner colorant used in this invention, appropriate pigments and dyes are used according to desired colors. Black toner includes carbon black, black iron oxide, and graphite. For a yellow toner, phorone-yellow, acetoacetanilide-based insoluble azo pigment, mono azo dye, and azomethine pigment etc. can be used as well as the benzidine-based yellow pigment used in the above Examples.

In addition to the azo pigments (naphthol-based insoluble azo pigment) used in the Examples for a magenta toner and quinacridone-based pigment, the following elements also can be used: tungstophosphomolybdate acid lake as a xanthene-based magenta dye; 2,9-dimethyl quinacridone; a naphthol-based insoluble azo pigment; anthraquinone-based dye; a coloring material comprising a xanthene-based dye and organic carboxylic acid; and thioindigo etc.

Cyan toner comprises, for example, a copper phthalocyanine-based pigment used in the Examples.

The charge control agents used for the toner in this invention are recited below. Positive charge control agents include nigrosine-based dye; alkoxyamine; quaternary ammonium salt; alkylamide; monomer and compound of phosphorus and tungsten; molybdic acid chelate pigment; benzothiazole derivatives; guanamine derivatives; triphenylmethanes derivatives; dibutyltin oxide and the mixture thereof.

The negative charge control agents include metal-containing salicylic acid-based compound, metal-containing mono azo dye-based compound. These charge control agents are added to the toner base particles, if necessary, and the content is 0.1–20 weight %, or preferably, 2–10 weight % to the toner base particles.

The additives used in this invention are fine particles such as alumina, silica and titania, which are hydrophobic-treated. As the agents for hydrophobic treatment, silane coupling agents such as hexamethyldisizane and dimethyldichlorosilane, or silicone oil can be used. The contents of these agents are 0.1–5 weight % per a toner.

As a method for preparing a toner used in this invention, a so-called kneading that is used in the Examples is generally used, in which treatments are carried out in the sequence of mixing, kneading, pulverization, classification and additives addition.

Mixing is a process of evenly dispersing materials such as binder resins, detachants, colorants and charge control agents by using mixers etc. provided to the disturbing blades or the like, to which well-known methods can be applied. In the kneading process, the mixed material is heated, and the internal additives are dispersed in the binder resin by shearing force. Any conventional heating and kneading apparatus can be used for the process.

The heating and kneading apparatus which heats and kneads by adding shearing force preferably includes, for example, a three-roll type, a one-shaft screw type, a two-shaft screw type and an intensive mixer type.

Pulverization is a process to roughly pulverize the chunk obtained in the above kneading process by using a cutter mill etc., and then further pulverizing by a jet mill etc. Classification is a process of removing fine particles by using a dispersion separator in order to obtain particles of a desired graininess. The pulverization and classification can be carried out with machines. There is a method of pulverizing particles by introducing the kneaded material to a minute gap between a fixed stator and a rotating rotor, or a method of classifying by using centrifugal force generated by a rotating rotor. Both methods are well known. In the process of providing the additives, the additives are provided to the toner base particles (classified particles) by using a well known mixer or some other apparatuses.

The toner can be made in another method, so-called polymerization, in which the above-identified toner materials such as colorants are mixed with the monomer for the binder resin, and this monomer composition is polymerized by a suspension polymerization method or by an emulsion polymerization method to obtain polymer particles having a diameter of a predetermined range, and the polymer particles are directly used as a toner.

INDUSTRIAL APPLICABILITY

As mentioned above, the toner layer forming devices of this invention can remove toners on rotary toner layer control members smoothly and form stable toner layers, and thus, they are applicable for toner layer forming devices used in developing devices for electrophotographic devices that form images by electrophotographic method, and the electrophotographic devices include printers, copiers, and facsimile machines.

We claim:

1. A toner layer forming device comprising:

a roller-type toner holding member that rotates in a predetermined direction while holding on its surface a nonmagnetic toner comprising a carnauba wax;

a roller-type rotary toner layer control member whose surface rotates in the reverse direction with respect to the surface of said toner holding member while contacting with the surface of said toner holding member in order to control said nonmagnetic toner layer; and a toner removing member that partially contacts with the surface of said toner layer control member in order to scrape off said nonmagnetic toner held on said rotary toner layer control member, wherein a substantially V-shaped groove region is formed between said toner holding member and said rotary toner layer control member in which said nonmagnetic toner moves cyclically so that said carnauba wax adheres to said rotary toner layer control member and to said toner removing member.

2. The toner layer forming device according to claim 1, wherein the content of said carnauba wax in said nonmagnetic toner is at least 0.1 weight %.

3. The toner layer forming device according to claim 1, wherein said toner removing member comprises a metallic or resin plate whose thickness ranges from 20–50 $\mu$m, and the edge of this plate contacts with the surface of the rotary toner layer control member.

4. The toner layer forming device according to claim 3, wherein said toner removing member is a plate of a material selected from the group consisting of stainless steel, phosphor bronze, and polyethylene terephthalate.

5. The toner layer forming device according to claim 1, wherein the surface of said rotary toner layer control member and the part of said toner removing member to contact with said rotary toner layer control member are made of identical metallic material.

6. The toner layer forming device according to claim 5, wherein said metallic material is stainless steel.

7. A toner layer forming device comprising:

a roller-type toner holding member that rotates in a predetermined direction while holding on the surface a nonmagnetic toner comprising a detachant having a melting point ranging from 80 to 90° C.;

a roller-type rotary toner layer control member whose surface rotates in the reverse direction with respect to the surface of said toner holding member while contacting with the surface of said toner holding member in order to control said nonmagnetic toner layer; and a toner removing member that partially contacts with the surface of said toner layer control member in order to scrape off said nonmagnetic toner held on said rotary toner layer control member, wherein a substantially V-shaped groove region is formed between said toner holding member and said rotary toner layer control member in which said nonmagnetic toner moves cyclically so that said detachant adheres to said rotary toner layer control member and to said toner removing member.

8. The toner layer forming device according to claim 7, wherein said detachant is a polyolefin-based wax, and the content of said polyolefin-based wax in said nonmagnetic toner is in the range of 2–20 weight %.

9. The toner layer forming device according to claim 7, wherein said toner removing member comprises a metallic or resin plate whose thickness ranges from 20–50 $\mu$m, and the edge of this plate contacts with the surface of the rotary toner layer control member.

10. The toner layer forming device according to claim 9, wherein said toner removing member is a plate of a material selected from the group consisting of stainless steel, phosphor bronze, and polyethylene terephthalate.

11. The toner layer forming device according to claim 7, wherein the surface of said rotary toner layer control member and the part of said toner removing member to contact with said rotary toner layer control member are made of identical metallic material.

12. The toner layer forming device according to claim 11, wherein said metallic material is stainless steel.

13. A toner layer forming device comprising:

a roller-type toner holding member that rotates in a predetermined direction while holding on the surface a nonmagnetic toner comprising a detachant;

a roller-type rotary toner layer control member whose surface rotates in the reverse direction with respect to the surface of said toner holding member while contacting with the surface of said toner holding member in order to control said nonmagnetic toner layer; and a voltage generator to apply a.c. bias between said rotary toner layer control member and said toner holding member, wherein a substantially V-shaped groove region is formed between said toner holding member and said rotary toner layer control member in which said nonmagnetic toner moves cyclically so that said detachant adheres to said rotary toner layer control member.

14. The toner layer forming device according to claim 13, wherein said detachant is a wax and the content of the wax in said nonmagnetic toner is at least 3 weight %.

15. The toner layer forming device according to claim 14, wherein said a.c. bias is more than 100 V and not more than 2000 V.

16. The toner layer forming device according to claim 13, wherein a surface resistance value of said toner holding member is greater than a volume resistance value.

17. The toner layer forming device according to claim 13, wherein said toner holding member has an elastic layer comprising a hard surface layer and an inner layer that is less hard than said surface layer.

18. The toner layer forming device according to claim 17, wherein an adhesive layer is formed between said surface layer and said inner layer in order to adhere the two layers.

* * * * *